US007153176B2

(12) United States Patent
Matsushima

(10) Patent No.: US 7,153,176 B2
(45) Date of Patent: Dec. 26, 2006

(54) METHOD FOR MANUFACTURING PLASMA DISPLAY PANEL USING PATTERNED MASK TO FORM RIBS

(75) Inventor: Hideaki Matsushima, Tokyo (JP)

(73) Assignee: Pioneer Corporation, Tokyo (JP)

( * ) Notice: Subject to any disclaimer, the term of this patent is extended or adjusted under 35 U.S.C. 154(b) by 69 days.

(21) Appl. No.: 10/848,382

(22) Filed: May 19, 2004

(65) Prior Publication Data

US 2004/0235385 A1 Nov. 25, 2004

(30) Foreign Application Priority Data

May 19, 2003 (JP) ..... 2003-140707

(51) Int. Cl.
*H01J 9/00* (2006.01)

(52) U.S. Cl. ..... 445/24; 313/584; 313/587

(58) Field of Classification Search ..... 313/582–587; 445/24–25

See application file for complete search history.

(56) References Cited

U.S. PATENT DOCUMENTS 6,403,477 B1 * 6/2002 Tounai ..... 438/669
2002/0118312 A1 * 8/2002 Ishizuka et al. ..... 348/797
2003/0132711 A1 * 7/2003 Yoo et al. ..... 313/584
2004/0113555 A1 * 6/2004 Han et al. ..... 313/586

FOREIGN PATENT DOCUMENTS

JP 2000-195431 A 7/2000
JP 2003-197111 A 7/2003
JP 2003-303542 A 10/2003

* cited by examiner

*Primary Examiner*—Joseph Williams
*Assistant Examiner*—Bumsuk Won
(74) *Attorney, Agent, or Firm*—Sughrue Mion, PLLC

(57) ABSTRACT

A method for manufacturing a plasma display panel is provided which is capable of enhancing luminance of a plasma display panel by forming a grid-shaped rib in the plasma display panel so as to be square-shaped. In the method for manufacturing a plasma display panel in which a front substrate and a rear substrate are arranged with the grid-shaped rib being interposed between the front substrate and the rear substrate in a manner in which both the substrates face each other, the grid-shaped rib is formed by using a resist mask in which a cut is formed only in both corner portions, in a pattern in a direction intersecting the column electrode, contacting a pattern parallel to the column electrode, in a pattern corresponding to a shape of the grid-shaped rib.

12 Claims, 10 Drawing Sheets

METHOD FOR MANUFACTURING PLASMA DISPLAY PANEL USING PATTERNED MASK TO FORM RIBS

BACKGROUND OF THE INVENTION

1. Field of the Invention

The present invention relates to a method for manufacturing a plasma display panel having a grid-shaped rib and a method for manufacturing a plasma display device using such the plasma display panel.

The present application claims priority of Japanese Patent Application No. 2003-140707 filed on May 19, 2003, which is hereby incorporated by reference.

2. Description of the Related Art

A general outline of a plasma display panel and a plasma display device and a conventional method for manufacturing such the plasma display panel and plasma display device will be first described. To increase ease of understanding, a stripe-shaped rib type plasma display panel having a rib that partitions discharge space formed in only one direction is described. FIG. 4 is an exploded perspective view schematically showing a configuration of a conventional stripe-shaped rib (partition wall) type plasma display panel 100. The stripe-shaped rib type plasma display panel 100 shown in FIG. 4 chiefly includes a front substrate 101 and a rear substrate 102.

The front substrate 101, as shown in an upper portion in FIG. 4, has a transparent glass substrate 103, bus electrodes 111 and bus electrodes 121 in a manner in which each of the bus electrodes 111 and each of the bus electrodes 121 are formed parallel to each other on the transparent glass substrate 103, scanning electrodes 112 each being made up of a transparent electrode and formed orthogonal to each of the bus electrodes 111 (FIG. 5), sustaining electrodes 122 each being made up of a transparent electrode and formed orthogonal to each of the bus electrodes 121 (FIG. 5). On the transparent glass substrate 103 is formed a transparent dielectric layer 131 in a manner in which it covers the bus electrodes 111 and bus electrodes 121 and scanning electrodes 112 and sustaining electrodes 122 and also is formed a surface protecting layer 132 in a manner in which it covers the transparent dielectric layer 131.

The rear substrate 102, as shown in a lower portion in FIG. 4, includes a transparent glass substrate 104, data electrodes 105 each being formed on the transparent glass substrate 104 in a manner in which each of them extends in a direction orthogonal to each of the scanning electrodes 112 and the sustaining electrodes 122, a white dielectric layer 106 formed on the transparent glass substrate 104 in a manner in which it covers the data electrodes 105, ribs 107 formed on the white dielectric layer 106 in a manner in which each of the ribs 107 partitions a display cell, and phosphor layers 108 each being formed on the white dielectric layer 106 and on a side surface of each of the ribs 107. Each of the phosphor layers 108 converts an ultraviolet ray being emitted by discharge of a discharge gas sealed between the front substrate 101 and the rear substrate 102 into visible light, with one phosphor layer being painted red (R), another phosphor layer being painted green (G), and a third phosphor layer being painted blue (B) in every display cell.

The front substrate 101 and the rear substrate 102 are configured so that they are fixed in an opposite state with a gap of about 100 μm between them and portions surrounding them are sealed hermetically. Space existing between the front substrate 101 and the rear substrate 102 serves as space for discharge gas and the discharge gas space is filled with a discharge gas consisting of helium, neon, xenon, or mixed gas of them. In the transparent glass substrate 104 making up the rear substrate 102 are formed air vents at appropriate places and on an outside surface of the transparent glass substrate 104 are stuck ventilating tubes, though not shown in FIG. 4, in a manner in which each of the ventilating tubes is aligned with each of the air vents and is kept in a hermetically sealed state.

An end portion of the ventilating tube being positioned opposite to another end portion being attached to the rear substrate 102 is kept in an open state at beginning of production and the ventilating tube is connected through the opened end portion to an exhaust/gas filling unit. After air is exhausted from the discharge gas space by using the exhaust/gas filling unit, the discharge gas space is filled with a discharge gas. After filling of the discharge gas has been completed, the ventilating tube is heated, melted, and chipped off and, as a result, the opened end portion is blocked. Thus, with the discharge gas space being filled with a discharge gas, manufacturing of the plasma display panel 100 is brought into perfection.

Next, an outline of a method for manufacturing the plasma display panel 100 shown in FIG. 4 is described below. First, the front substrate 101 is manufactured by an ordinarily known method. Then, after having formed the scanning electrodes 112 and sustaining electrodes 122 on the front substrate 101, by employing a known screen printing technique, the bus electrodes 111 are formed on the scanning electrodes 112 and the bus electrodes 121 on the sustaining electrodes 122. Similarly, the rear substrate 101 is manufactured by an ordinarily known method. At this point, the data electrodes 105 are formed by using the known screen printing method. After having coated either of the front substrate 101 or rear substrate 102, or portions surrounding both the front substrate 101 and rear substrate 102 with a melting agent, the front substrate 101 and the rear substrate 102 are fixed, by using a clip, in a manner in which they face each other.

Next, portions surrounding the air vents formed on the transparent glass layer 104 in the rear substrate 102 are coated with the melting agent to fix the ventilating tube and both a process of sealing both the front substrate 101 and the rear substrate 102 and a process of sticking the ventilating tube to the rear substrate 102 are performed simultaneously. Then, after exhausting air from an inside of the plasma display panel through the ventilating tube and air vent, the inside of the plasma display panel 100 is filled with the discharge gas. Thus, the manufacturing of the plasma display panel 100 is completed.

Next, a grid-shaped rib type plasma display panel with each display cell being partitioned by a grid-shaped rib is described. FIG. 5 is an exploded perspective view schematically showing a configuration of a grid-shaped rib type plasma display panel 100A to which both the conventional technology and the technology of the present invention are applied. In descriptions below, points of configurations of the grid-shaped rib type plasma display panel 100A being different from the stripe-shaped rib type plasma display panel 100 shown in FIG. 4 are mainly explained and, in FIG. 5 same reference numbers are assigned to components having the same function as those in FIG. 4.

In the grid-shaped rib type plasma display panel 100A shown in FIG. 5, in addition to the stripe-shaped rib 107 formed in a longitudinal direction in the stripe-shaped rib type plasma display panel 100A, the grid-shaped rib 109 is formed in a horizontal direction as shown in FIG. 5 and in a portion surrounded by the stripe-shaped rib 107 formed in a longitudinal direction and by the grid-shaped rib 109 formed in a horizontal direction, for example, rectangular discharge space 140 is provided. Each of scanning electrodes 112 being connected to each of bus electrodes 111 and each of sustaining electrodes 122 being connected to bus electrodes 121 all being formed on a front substrate 101 are placed on an upper portion of the discharge space 40 in a manner in which each of the scanning electrodes 112 and each of the sustaining electrodes 122 face each of data electrodes 105 with the discharge space 140 being interposed between each of the scanning electrodes 112 and each of the sustaining electrodes 122 and each of the data electrodes 105 formed on a rear substrate 102 and extending to a corresponding position.

In each discharge space 140, while the grid-shaped rib type plasma display panel 100A is operated, by applying a high-pressure pulse to the first bus electrodes 111, discharge of a gas being sealed is started between the scanning electrodes 112 and the data electrodes 105 being positioned in a lower portion in the discharge space 140. Then, by stopping a supply of power to the bus electrodes 111 and by applying a low-pressure pulse to the second bus electrodes 121, discharge is maintained between the sustaining electrodes 122 and scanning electrodes 112. Each of the phosphor layer 108 being applied to an inside of the grid-shaped rib 109, by a stimulus from an ultraviolet ray produced by the discharge of the gas being sealed, emits light peculiar to the phosphor used. Thus, each discharge space 140 surrounded by the grid-spaced rib 109 and by the stripe-shaped rib 107, because one color out of three colors making up one pixel in the plasma display panel 100A is emitted and displayed in the discharge space 140, is called a "unit display cell". Moreover, the scanning electrodes and sustaining electrodes, because both the electrodes are controlled via the bus electrodes in a row direction of pixels making up a screen, are called "row electrodes". The data electrodes, because they are controlled in a column direction of pixels making up a screen, is called "column electrodes".

In the plasma display panel having the stripe-shaped rib described above, since the rib is arranged in parallel in a longitudinal direction, interference between neighboring cells arranged in a horizontal direction can be suppressed, however, suppression of interference between neighboring cells in a longitudinal direction is difficult. Therefore, distance between neighboring cells in a longitudinal direction has to be increased, which causes a decrease in an aperture rate of a pixel contributing to emission of light and produces a difficult problem in that it is difficult to improve luminance of a plasma display panel. However, in the plasma display panel having the grid-shaped rib, such the problem as described above does not exist and therefore intervals among display cells making up pixels being adjacent to one another in a longitudinal direction can be shortened, which enables an aperture rate of pixels contributing to emission of light to be increased and luminance of the plasma display panel to be improved and, as a result, the grid-shaped rib type plasma display panel is widely used in recent years.

A method for forming a grid-shaped rib employed in the grid-shaped rib type plasma display panel 100A is described below. First, after the data electrodes 105 have been formed on the rear substrate 102, a white dielectric layer is formed on the data electrodes 105 and, further, after the white dielectric layer have been coated with a rib material obtained by mixing an insulating glass power with a binder until it has a predetermined thickness, a photosensitive dry film is stuck on the rib material. After the photosensitive dry film has been exposed through a photomask having a desired pattern, development processing is performed so that a patterned resist mask layer is formed on the rib material.

By spraying a cutting agent consisting of fine particles of a polishing agent on the patterned resist mask layer, using a sandblast method, to cut and remove portions other than the resist mask layer, a required pattern is carved into the rib material until it reaches the white dielectric layer 106 to form the grid-shaped rib. After that, the resist mask layer is removed and the rib portion is baked so as to be solidified. By coating an inner portion of each of the grid-shaped rib thus formed with the phosphor having a color corresponding to a color emitted in each discharge space and by drying the coated portion, the phosphor layer 108 is formed on the white dielectric layer 106 and on side walls of the grid-shaped rib 109.

Then, the front substrate 101 is overlaid on the rear substrate 102 formed as above. The scanning electrodes 112 and sustaining electrodes 122 formed on a transparent dielectric layer 131 in the front substrate 101 are arranged inside the discharge space 140 in a manner in which each of the scanning electrode 112 and each of the sustaining electrodes 122 face each of the data electrodes 105 formed on the rear substrate 102. After the rear substrate 102 and the front substrate 101 have been put together, by exhausting air from each discharge space 140 and by filling each discharge space with a discharge gas, the manufacturing of the plasma display panel 100A is completed.

Because a shape of the grid-shaped rib is complicated compared with the stripe-shaped rib, their formation had been difficult. However, the sandblast method developed in recent years can provide easier micromachining compared with other manufacturing methods and, therefore, the grid-shaped rib type plasma display panel has come to be manufactured easily by using the sandblast method and use of the grid-shaped rib type plasma display panel is becoming wider accordingly. Moreover, such the grid-shaped rib type plasma display panel as described above is disclosed in Japanese Patent Application Laid-open No. 2000-195431.

FIG. 6 is a diagram partially showing a resist mask employed in the conventional method for manufacturing the grid-shaped rib type plasma display panel. A resist mask 145 used in the conventional method for manufacturing a grid-shaped rib for a plasma display panel has a shape shown in FIG. 6 and is made up of a light-shielding portion 146 consisting of a pattern that corresponds to a shape of an upper surface of the grid-shaped rib 109 forming the discharge space and an aperture portion 147 being portions other than the light-shielding portion 146.

FIG. 7 is a diagram showing an example of a display cell formed when the grid-shaped rib is fabricated using the resist mask as shown in FIG. 6 by the sandblast method. When grid-shaped rib formed in a plasma display panel is produced, by the sandblast method, using the conventional resist mask having a straight-line-shaped configuration as shown in FIG. 6, a corner portion of each of the grid-shaped rib formed on the rear substrate 102 becomes round as shown in FIG. 7 and the grid-shaped rib is not formed in a manner in which it has a shape correctly corresponding to a pattern so produced as to have such a square-shaped corner portion as shown in the resist mask 145 in FIG. 6 and, as a result, a corner portion of each of the phosphor layers 149 formed in the rib becomes roundish.

The reasons for the above phenomenon are that a grain size of the cutting agent to be used-in the sandblast method is not allowed to be made so small and an aperture rate of a resist pattern on the rib material applied in the corner portion becomes small which causes a cutting speed to become low in the corner portion compared with that in other portions, and a development speed in the corner portion becomes low compared with that in other portion at time of development processing on a photosensitive dry film in the previous process and therefore resolution of the portion is lowered, thus causing the corner portion of the resist pattern resulting from the development to become roundish.

Another method for manufacturing a plasma display panel is disclosed in Japanese Patent Application Laid-open No. 2003-197111 (Paragraphs 0026 to 0029, FIGS. 2 and 3) in which an inner surface of a phosphor layer being positioned to face a discharge space is so formed as to be square-shaped by using a mask having a cut pattern in a location corresponding to a corner portion in a grid-shaped rib at time of formation of the grid-shaped rib by a sandblast method.

FIG. 8 shows a resist mask 151 used in the disclosed conventional technology. As shown in FIG. 8, the resist mask 151 has a cut 154 in a corner portion of an aperture portion 153 which is formed inside of a light-shielding portion 152 of the resist mask 151. When the grid-shaped rib is formed by the sandblast method using such the resist mask 151 as above, space is increased by the cut 154, causing reduction in a decrease in a speed of cutting a rib material due to lowering of speed, occurring in an area near to the corner portion, caused by mutual collision of particles of a cutting agent, which, as a result, enables the cut 154 to be formed.

FIG. 9 is an expanded plan view of a display cell formed on a rear substrate using the resist mask 151 employed in the conventional manufacturing method. As shown in FIG. 9, since a grid-shaped rib 155 has a cut 156 in its corner portion, when coating with a phosphor paste is performed, an excessive amount of the phosphor paste enters into the cut 156 and, therefore, an inner surface of a phosphor layer 157 formed in an inner wall of the grid-shaped rib 155 is formed so as to be square-shaped.

FIG. 10 is a schematic block diagram showing configurations of a plasma display device to which the conventional technology and the technology of the present invention are applied. The plasma display device 200 shown in FIG. 10 chiefly includes an analog interface 220 and a plasma display panel module 230. The plasma display panel module 230 has a plasma display panel 250.

The analog interface 220 is constructed of a Y/C separating circuit 221 having a chroma decoder, an A/D (Analog/Digital) converting circuit 222, a synchronous signal control circuit 223 having a PLL (Phase-Locked Loop) circuit, an image format converting circuit 224, a reverse gamma (γ) converting circuit 225, a system control circuit 226, and a PLE (Peak Luminance Enhancement) control circuit 227. The analog interface 220 chiefly has a function of converting a received analog image signal into a digital signal to feed the signal to the plasma display panel module 230.

For example, an analog image signal transmitted from a TV (Television) tuner, after having been split into each of R (Red), G (Green), and B (Blue) color signals in the Y/C separating circuit 221, is converted into a digital signal by the A/D converting circuit 222. Then, when a configuration of a pixel provided by the plasma display panel module 230 is different from that of a pixel provided by a video signal, necessary processing of converting an image format is performed by the image format converting circuit 224.

A characteristic of display luminance to an input signal in a plasma display panel has linearity. However, a (γ) correction to an ordinary image signal is made in advance to be matched to a characteristic of a CRT (Cathode Ray Tube). After the A/D converting circuit 222 has performed A/D conversion of an image signal, the reverse gamma (γ) conversion performs a reverse gamma (γ) conversion on the image signal to produce a digital image signal reconstructed so as to have a linear characteristic. The digital image signal produced as above is output as an RGB image signal to the plasma display panel module 230.

Since a sampling clock signal to be used for the A/D conversion and a data clock signal are not contained in an analog image signal, the PLL circuit embedded in the synchronous signal control circuit 223 produces the sampling clock signal and the data clock signal by using a horizontal sync signal fed at the same time as an analog image signal as a reference and feeds them to the plasma display panel module 230. The PLE control circuit 227 included in the analog interface 220 exerts control on luminance of the plasma display panel. More specifically, control is exerted so that, if an average luminance level is a specified value or less, the display luminance is enhanced and if the average luminance level exceeds the specified value, the display luminance is lowered. The system control circuit 226 outputs various control signal to the plasma display panel module 230.

The plasma display panel module 230 is made up of a digital signal processing/control circuit 231, a panel portion 232, an in-module power circuit 233 embedding a DC/DC (Direct Current/Direct Current) converter. The digital signal processing/control circuit 231 includes an input interface signal processing circuit 234, a frame memory 235, a memory control circuit 236, or a driver control circuit 237.

For example, an average luminance level input to the input interface signal processing circuit 234 is calculated by an input signal average luminance level operating circuit (not shown) and is output as, for example, 5-bit data. Moreover, the PLE control circuit 227 sets PLE control data according to an average luminance level and feeds the set data to a luminance level control circuit (not shown) in the input interface signal processing circuit 234.

The digital signal processing/control circuit 231, after having made the input interface signal processing circuit 234 perform processing of various signals, transmits a control signal to the panel section 232. At the same time, the memory control circuit 236 transmits a memory control signal to the panel section 232 and the driver control circuit 237 transmits a driver control signal to the panel section 232.

The panel section 232 is constructed of a plasma display panel 250 fabricated by the method for manufacturing a plasma display panel described above, a scanning driver 238 to drive a scanning electrode of the plasma display panel 250, a data driver 239 to drive a data electrode of the plasma display panel 250, a high-pressure pulse circuit 240 to apply a pulse voltage to the plasma display panel 250 and the scanning driver 238, and a power collecting circuit 241 to collect excessive power from the high-pressure pulse circuit 240.

The plasma display panel 250 is made up of 1365×768 pixels arranged. In the plasma display panel 250, the scanning electrode is controlled by the scanning driver 238 and the data electrode is controlled by the data driver 239 so that a specified pixel out of the 1365×768 pixels is turned ON or OFF to achieve a desired display. Moreover, a power for logic circuits (not shown) feeds power for logical operations to the digital signal processing/control circuit and to the panel section 232. The in-module power circuit 233, to which direct power is supplied from display power, converts a voltage of the direct current power into a specified voltage and then feeds it to the panel section 232.

Next, an outline of the method for manufacturing the plasma display device shown in FIG. 10 is explained. The plasma display panel 250 fabricated by the method for manufacturing the plasma display panel described above, scanning driver 238, data driver 239, high-pressure circuit 240, and power collecting circuit 241 are arranged on a substrate to form the panel section 232. More over, in addition to the panel section 232, the digital signal processing/control circuit 231 is formed.

Assembly of the panel section 232, digital signal processing/control circuit 231, and in-module power circuit 233 fabricated as above are done to construct one module so that a plasma display module 230 is formed. In addition to the plasma display panel module 230, the analog interface 220 is fabricated.

By fabricating the analog interface 220 and the plasma display panel module 230 separately and by electrically connecting both of them, the plasma display device 200 as shown in FIG. 10 is completed. Thus, by fabricating the plasma display panel 250 as one module, the plasma display panel 250 can be manufactured separately and independently of other components making up the plasma display device 200. Therefore, for example, if a failure occurs in the plasma display panel 250 in the plasma display device 200, by replacing the detective plasma display panel 250 with a new one as a whole, a repair process is simplified and a period for the repair can be shortened.

However, the conventional method described above has a problem. That is, when the grid-shaped rib of a plasma display panel is fabricated by the sandblast method, even if cutting is performed by using the resist mask having a straight-line shaped configuration as shown in FIG. 6 as the grid-shaped rib becomes high definition, a corner portion of the grid-shaped rib 148 formed on the rear substrate 101 becomes roundish and it is difficult to form a grid-shaped rib correctly corresponding to a pattern produced so that the corner portion is square-shaped as shown by the resist mask 145 in FIG. 6. The reasons for the above phenomenon are that a grain size of the cutting agent to be used in the sandblast method is not allowed to be made so small and an aperture rate of a resist pattern on the rib material applied in the corner portion becomes small which causes a cutting speed to become low in the corner portion compared with that in other portions, and a development speed in the corner portion becomes low compared with that in other portion at time of development processing on a photosensitive dry film in the previous process and, therefore, resolution of the portion is lowered, thus causing the corner portion of the resist pattern resulting from the development to become roundish.

If a corner of a grid-shaped rib formed on a rear substrate becomes round, effective discharge space in a display cell becomes narrow and, therefore, expansion of discharge is suppressed and an amount of generated ultraviolet light decreases and an area for coating with a phosphor is reduced and, as a result, efficiency for conversion of ultraviolet light into visible light is lowered, thus causing luminance of the plasma display panel to be reduced.

Moreover, a method is not easy practically, even by adjusting a size of the cut 154, an amount of jetted cutting agent, a jetting speed, or a like, in which, by cutting the resist mask 151 using the sandblast method so as to form the cut 154 in a corner portion in a position corresponding to a portion where the longitudinal rib and horizontal rib in the light-shielding portion 152 in the resist mask 151 as shown in FIG. 8 cross each other, a portion where the longitudinal grid-shaped rib and the horizontal grid-shaped rib cross each other is formed so as to be square-shaped. This is because the cutting agent is hard to be put into such the corner portion at time of the sandblast processing.

That is, the formation of the rib by the sandblast method is performed by such the method as described in Japanese Patent Application Laid-open No. 2003-303542 (Paragraphs 0002 to 0004, FIG. 7). Though the method for forming the rib disclosed in the above Japanese Patent Application Laid-open No. 2003-303542 is employed when a stripe-shaped rib is formed, this method can be also applied to the formation of a grid-shaped (parallel-cross shaped) rib. That is, two or more nozzles to be used for spraying a cutting agent are arranged in a row (horizontal) direction and, while the plasma display panel is being moved at a low speed, by making a row of nozzles run in a reciprocal manner in a column (longitudinal) direction, a cutting agent is sprayed on a rib material and a mask material.

At this point, since the row of nozzles sprays the cutting agent while it is moving in a column direction, the cutting agent is sprayed on the mask material somewhat obliquely and therefore a cut process in a column direction is comparatively easy, however, a cut process in a row direction is comparatively difficult. Moreover, though the cutting agent, after having been sprayed on the mask material, collides with a substrate, bounces off and is exhausted, in the case of a rectangular grid-shaped rib, a running direction of a nozzle is a direction of a longer side of a grid. This is because, if the running direction of the nozzle is a direction of a short side of the grid, the cutting agent is difficult to be exhausted, which causes a cutting speed to be reduced.

A width of the grid-shaped rib in a row direction is made larger than that in a column direction. Therefore, by making a cut in the rib in a row direction which has a larger width, a process margin can be increased.

Moreover, while the sandblast processing is performed, since a substrate moves to a direction of arrangement of a row of electrodes and a nozzle moves in a reciprocal manner in a direction orthogonal to a direction of movement of the substrate, it is convenient in terms of ease of controlling that a direction of a cut formed in the rib is a column direction. However, conventionally, consideration related to these points is not given to a shape of a mask when the sandblast method is employed.

SUMMARY OF THE INVENTION

In view of the above, it is an object of the present invention to provide a method for manufacturing a plasma display panel which is capable of improving luminance of a plasma display panel by widening discharge space of a display cell and increasing an area coated with a phosphor and a method for manufacturing a plasma display device employing the above plasma display panel.

According to a first aspect of the present invention, there is provided a method for manufacturing a plasma display panel in which a front substrate having row electrodes and a rear substrate having column electrodes extending in a direction intersecting the row electrodes are arranged with a grid-shaped rib being interposed between the front substrate and the rear substrate in a manner in which the front substrate and the rear substrate face each other, the method including:

a step of forming the grid-shaped rib using a mask having a pattern corresponding to a shape of the grid-shaped rib in which cuts are formed only in corner portions, in a pattern in a direction intersecting the column electrodes, contacting a pattern parallel to the column electrodes in a pattern corresponding to a shape of the grid-shaped rib.

In the foregoing, a preferable mode is one wherein a pattern corresponding to the grid-shaped rib in a direction intersecting the column electrodes in the mask is formed so as to have a width being larger than that of a pattern in a direction parallel to the column electrodes.

Also, a preferable mode is one wherein the cut is formed so as to have a square shape being parallel to a pattern in a direction intersecting the column electrodes and to a pattern in a direction parallel to the column electrodes or so as to have a triangular shape whose one side is defined by a pattern parallel to the column electrodes in which a width of a pattern in a direction intersecting the column electrodes tapers down from a side being far from a pattern parallel to the column electrodes toward a side being near to the pattern.

According to a second aspect of the present invention, there is provided a method for manufacturing a plasma display panel in which a front substrate having row electrodes and a rear substrate having column electrodes extending in a direction intersecting the row electrodes are arranged with the grid-shaped rib being interposed between the front substrates and the rear substrate in a manner in which the front substrate and the rear substrate face each other, wherein a width of the grid-shaped rib in a row direction is made larger than that in a column direction, the method including:

a step of forming the grid-shaped rib using a mask having a pattern corresponding to the grid-shaped rib and having a cut in a corner portion of a pattern corresponding to the rib in the row direction.

In the foregoing, a preferable mode is one wherein a width and a depth of the cut is 30 μm or more to less than 50 μm.

Also, a preferable mode is one wherein the mask is a resist mask to be used in a sandblast method and the grid-shaped rib is formed by the sandblast method.

According to a third aspect of the present invention, there is provided a method for manufacturing a plasma display panel including:

a step of forming the rib material so as to have a specified thickness;

a step of forming a grid-shaped pattern mask material having a cut made up of a first portion and a second portion both crossing each other on the rib material and formed in a location being near to a location where a portion in the first direction and a portion in the second direction cross each other; and a step of spraying a cutting agent on the rib material and a masking agent from a nozzle moving in the second direction, hereby forming a grid-shaped rib.

According to a fourth aspect of the present invention, there is provided a method for manufacturing a plasma display panel in which discharge space is partitioned by a horizontal rib and a longitudinal rib both crossing one other and each having a different width, the method including:

a step of forming the horizontal rib and longitudinal rib by using a mask having a pattern corresponding to the horizontal rib and longitudinal rib and having a cut formed in a corner portion of a pattern corresponding to one rib whose width is larger than that of another out of the horizontal rib and longitudinal rib.

According to a fifth aspect of the present invention, there is provided a method for manufacturing a plasma display device including:

a first step of manufacturing a plasma display panel;

a second step of manufacturing the plasma display panel and a circuit to drive the plasma display panel as one module;

a third step of electrically connecting an interface to the module, the interface which converts a format of an image signal and transmits the converted image signal to the module;

wherein, in the first step, a grid-shaped rib is formed using a mask in which a cut is formed only in both corner portions contacting a pattern parallel to a column electrode in a pattern in a direction intersecting the column electrode.

With the above configuration, since the corner portion of the grid-shaped rib can be formed so as to be square-shaped, discharge space in a display cell can be widened and an area to be coated with a phosphor can be increased and therefore luminance of a plasma display panel can be enhanced, which enables improvement of performance of the plasma display panel without causing a rise in manufacturing costs.

with still another configuration, when the grid-shaped rib is formed by a sandblast method using a resist mask, since a cut is formed only in a corner portion of an aperture portion of the resist mask, space for processing can be widened and a speed of cutting a rib material in a portion near to the corner portion can be improved, which enables reduction in processing time and in manufacturing costs.

Moreover, the method for manufacturing a plasma display panel and a plasma display device of the present invention can be used not only in manufacturing a plasma display panel for television or a plasma display device for television but also in manufacturing a plasma display panel and a plasma display device to be employed as a display device for all kinds of computer device, control device, measuring device, recreational apparatus and other various devices.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

In embodiments of the present invention, when a plasma display panel is manufactured in which a front substrate having row electrodes and a rear substrate having column electrodes extending in a direction in which the row and column electrodes cross each other are arranged in opposite to each other with a grid-shaped rib being interposed between the front substrate and the rear substrate, the grid-shaped rib is formed by using a resist mask in which a cut is formed only in both corner portions, in a pattern in a direction intersecting the column electrode, contacting a,pattern parallel to the column electrode, in a pattern corresponding to a shape of the grid-shaped rib.

First Embodiment

Figure 1A:
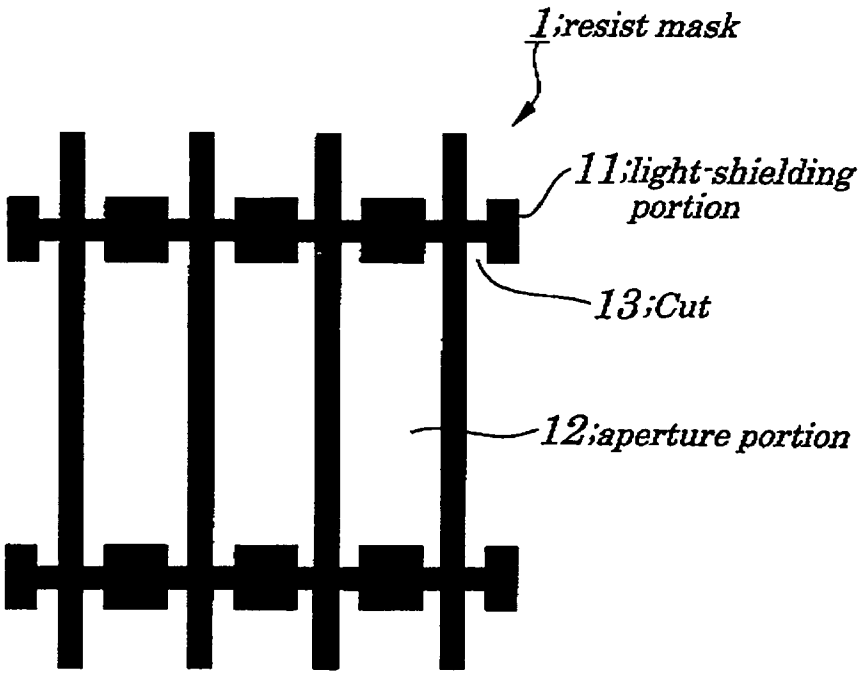
FIGS. 1A and 1B are diagrams showing a shape of a resist mask employed in a method for manufacturing a plasma display panel according to a first embodiment of the present invention.
Figure 1B:
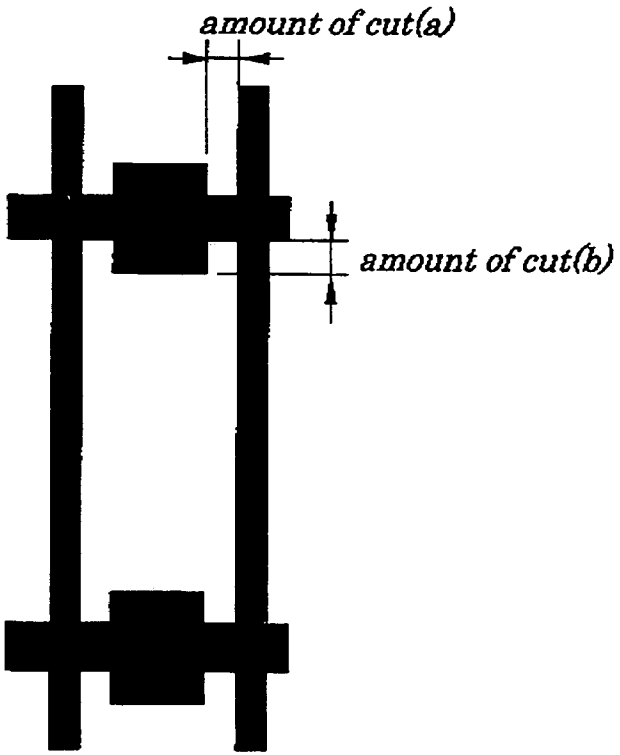
Figure 2:
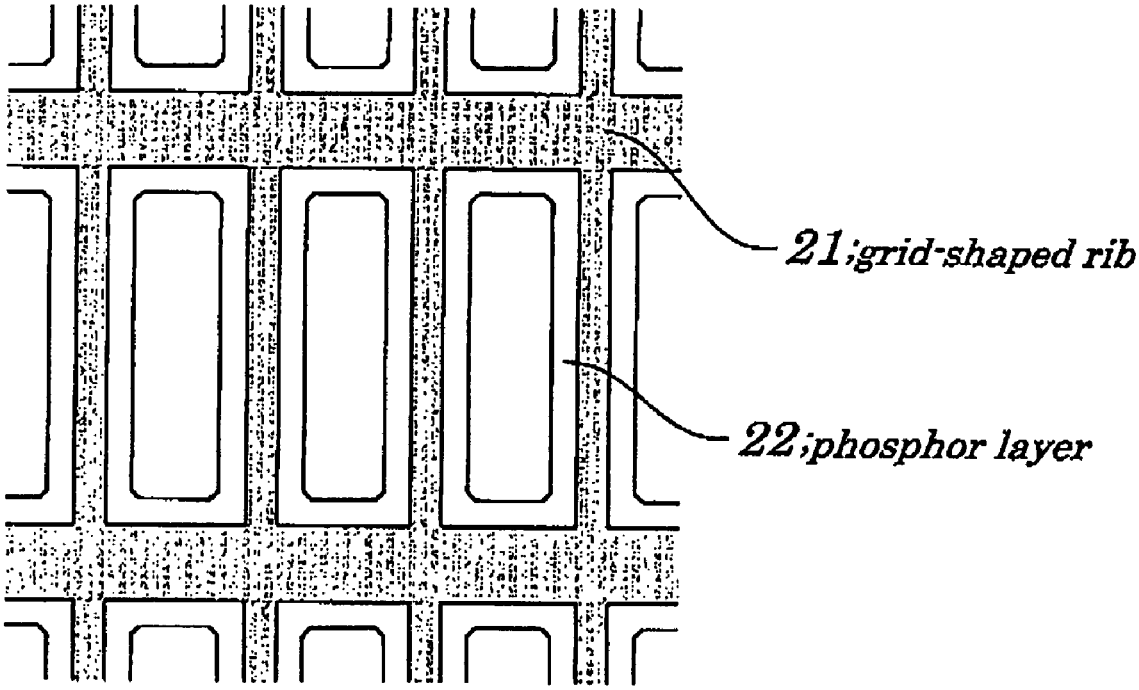
FIG. 2 is a diagram showing a shape of a grid-shaped rib manufactured using the resist mask employed in the method for manufacturing a plasma display panel according to the first embodiment of the present invention.
Figure 5:
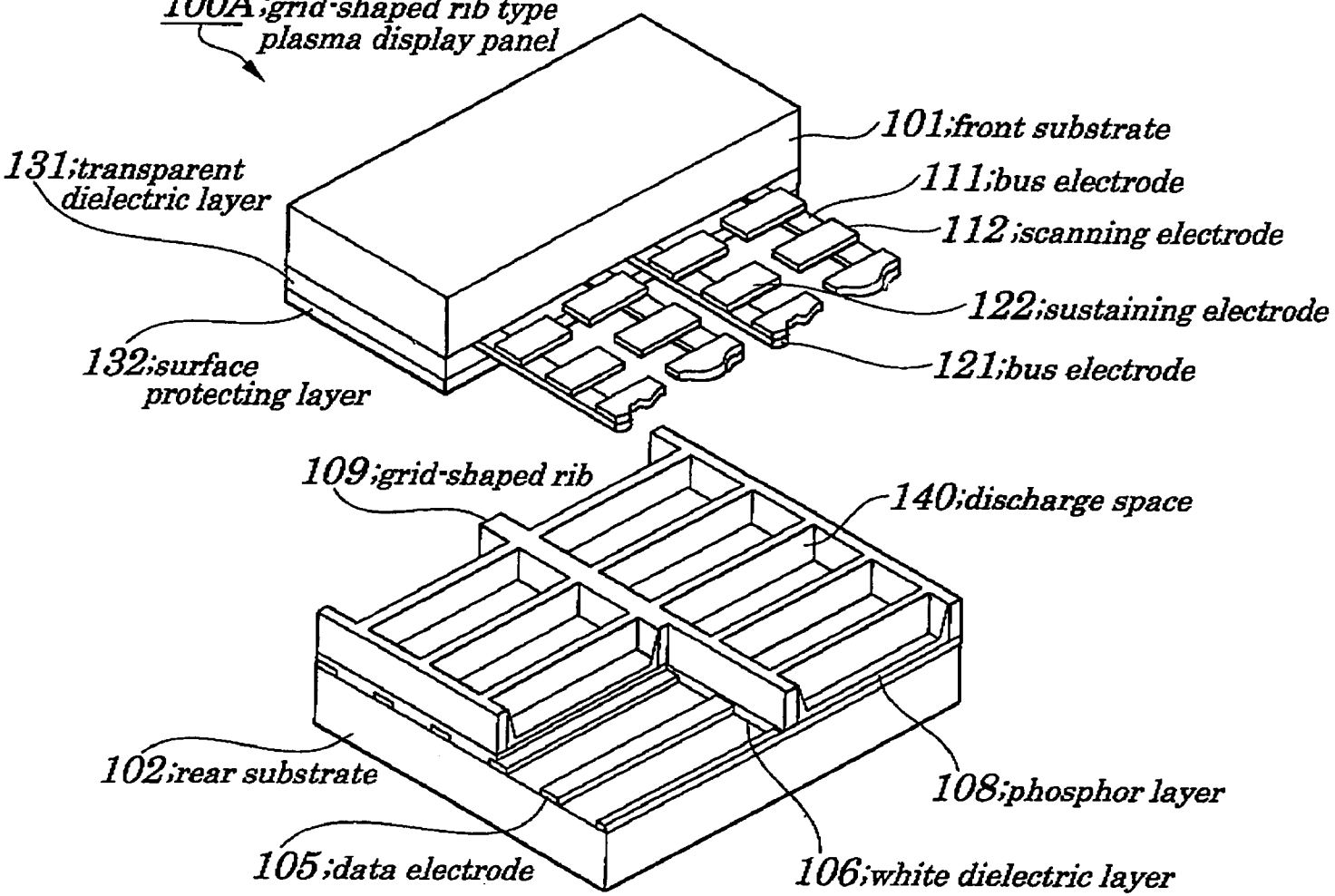
FIG.5 (PRIOR ART)
FIG. 5 is an exploded perspective view schematically showing a configuration of a grid-shaped rib type plasma display panel to which the conventional technology and the technology of the present invention are applied.
Figure 6:
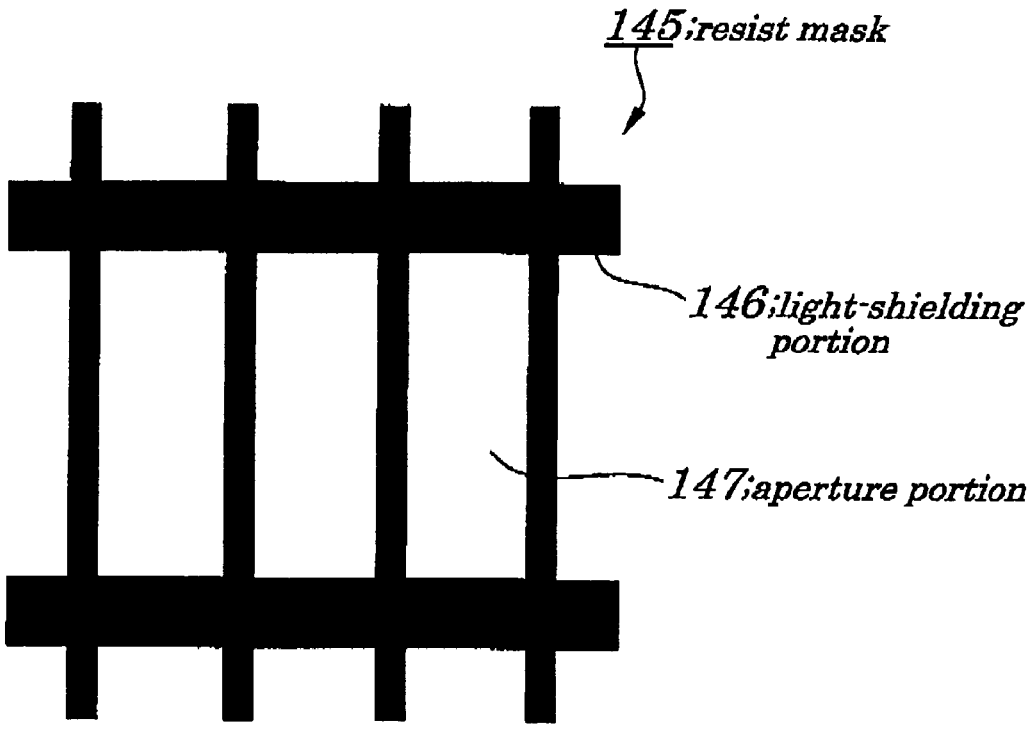
FIG.6 (PRIOR ART)
FIG. 6 is a diagram showing a first example of a resist mask employed in the conventional method for manufacturing a grid-shaped rib type plasma display panel.
Figure 7:
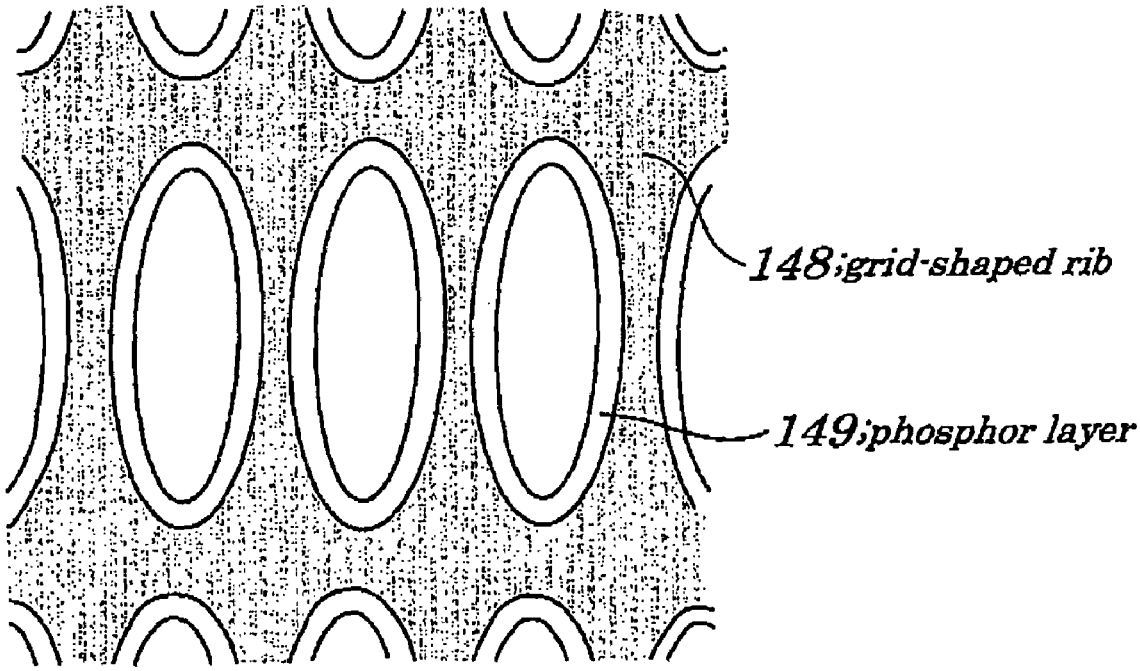
FIG. 7 (PRIOR ART)
FIG. 7 is a diagram showing an example of a shape of a display cell manufactured by the resist mask employed in the conventional method for manufacturing a grid-shaped rib type plasma display panel.
Figure 8:
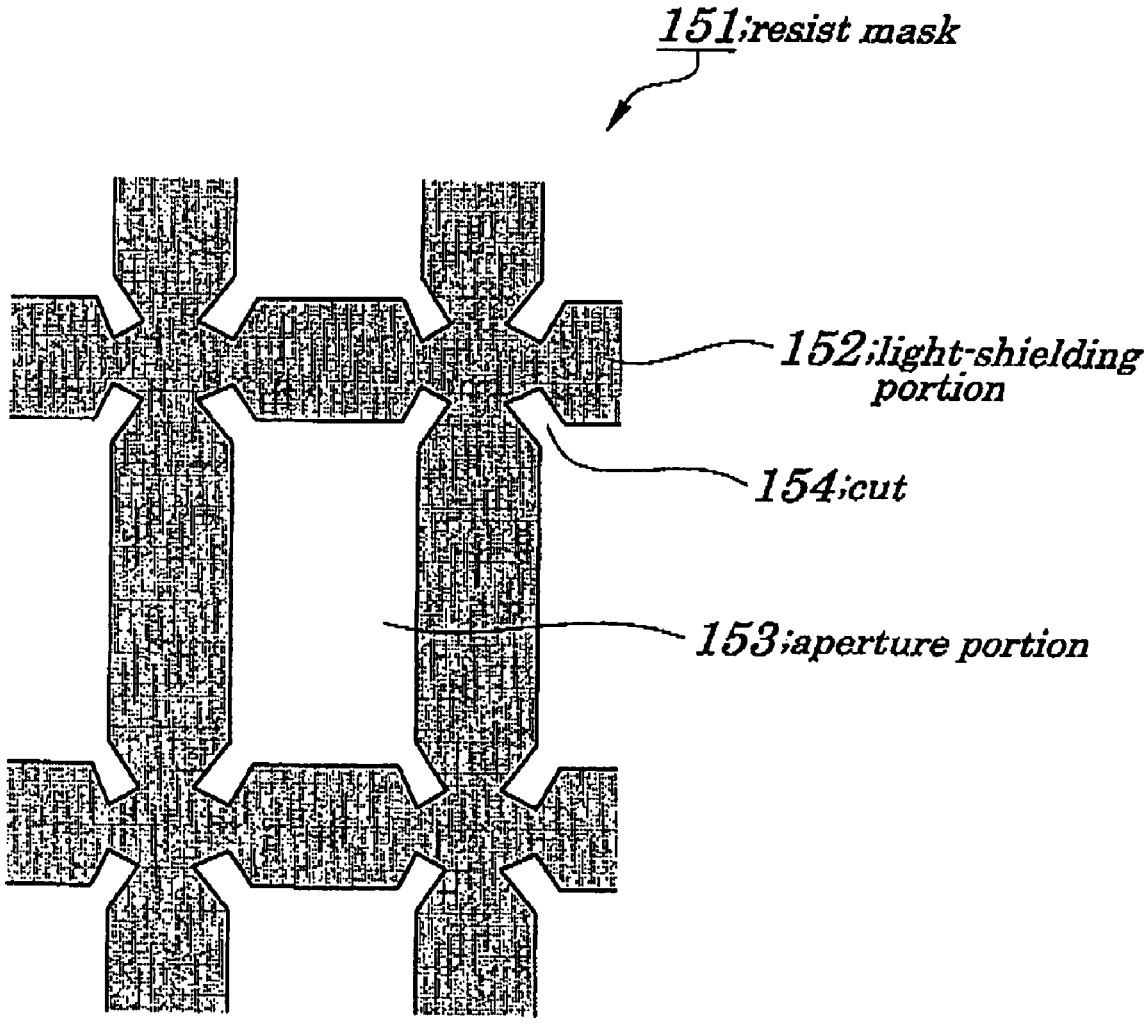
FIG.8 (PRIOR ART)
FIG. 8 is a diagram showing a second example of a resist mask employed in the conventional method for manufacturing a grid-shaped rib type plasma display panel.
Figure 9:
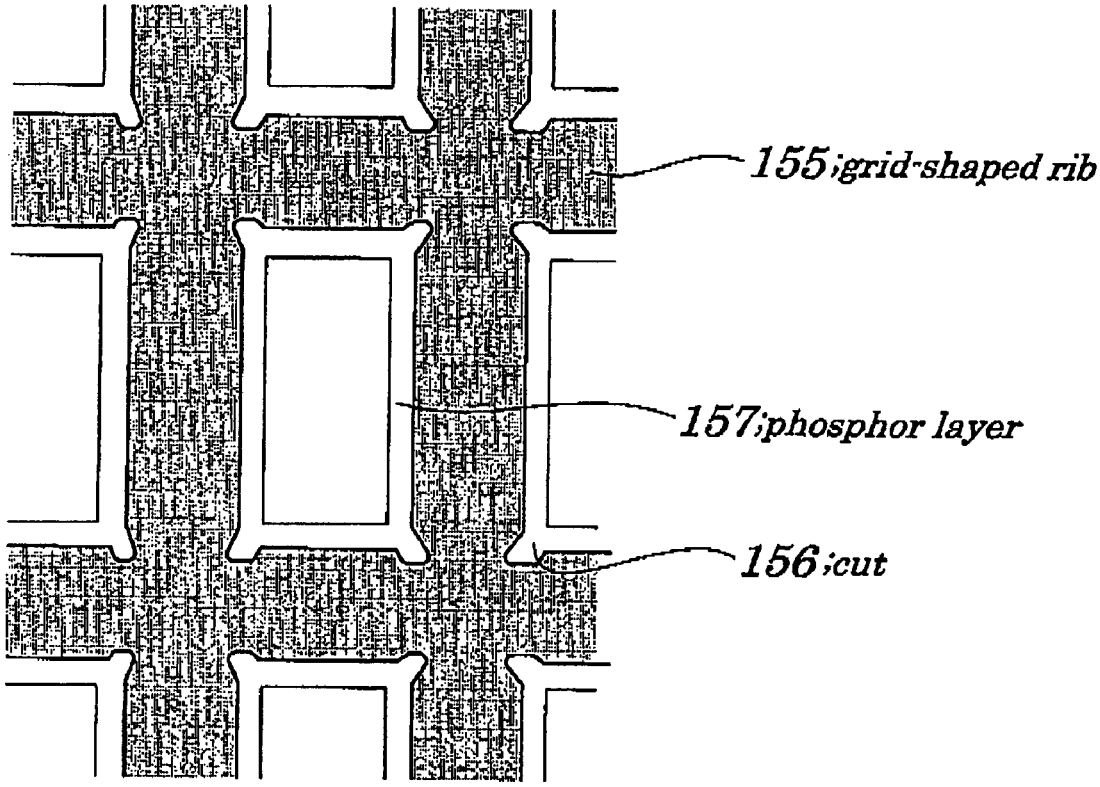
FIG.9 (PRIOR ART)
FIG. 9 is a diagram showing an example of a shape of a display cell manufactured by the resist mask employed in the conventional method for manufacturing a grid-shaped rib type plasma display panel.
Figure 10:
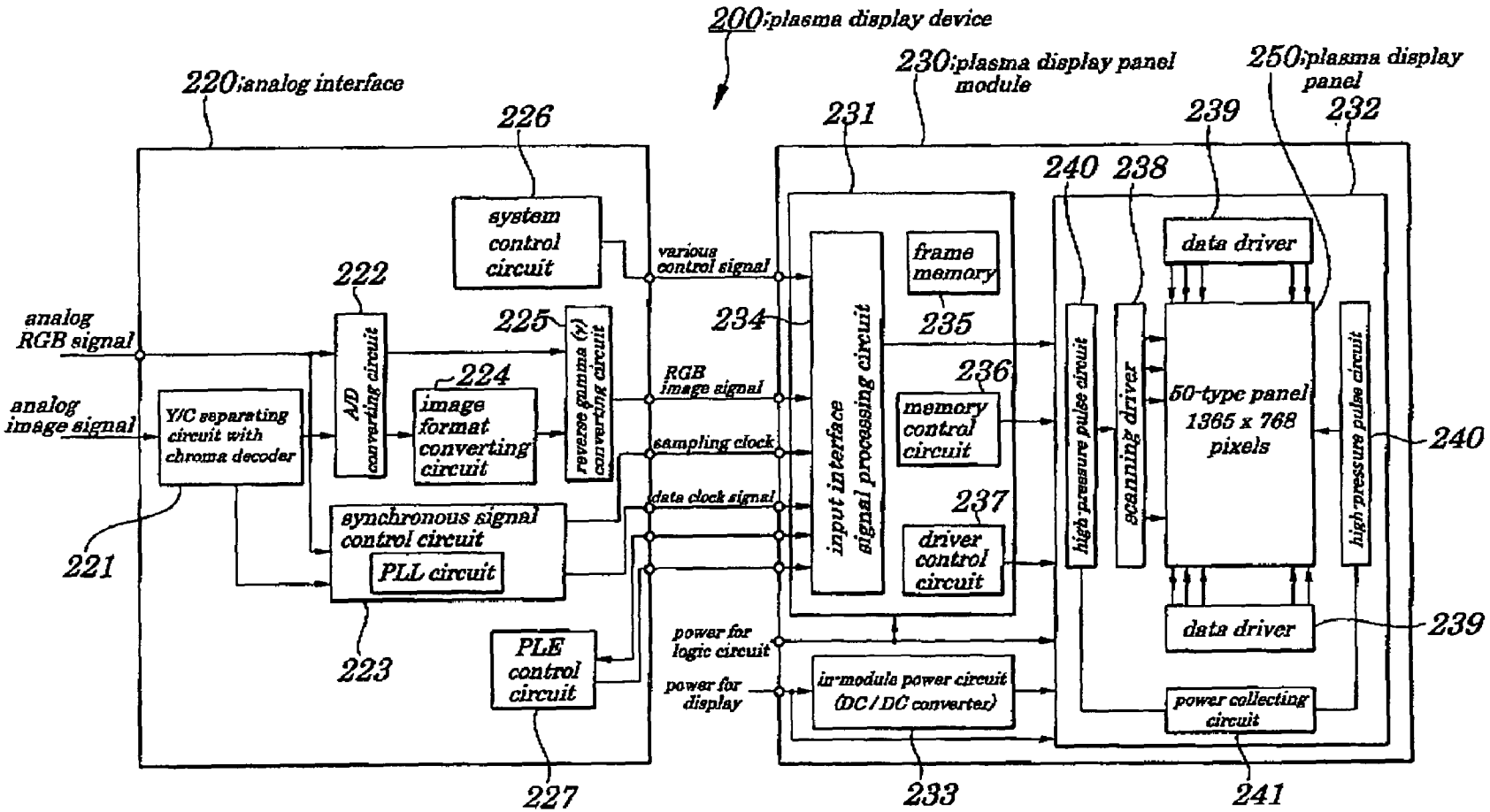
FIG. 10 (PRIOR ART)
FIG. 10 is a schematic block diagram showing configurations of a plasma display device to which the conventional technology and the technology of the present invention are applied.

FIGS. 1A and 1B are diagrams showing a shape of a resist mask employed in a method for manufacturing a plasma display panel according to a first embodiment of the present invention. FIG. 2 is a diagram showing a shape of a grid-shaped rib manufactured using the resist mask employed in the method for manufacturing a plasma display panel according to the first embodiment. Configurations and manufacturing method of the plasma display panel and configurations and manufacturing method of the plasma display device of the present invention are the same as those in the conventional examples shown in FIG. 5 and FIG. 10 and their descriptions in detail are omitted accordingly. The present invention is featured by a method for manufacturing the grid-shaped rib formed on a rear substrate of the plasma display panel and by the shape of the resist mask employed in a sandblast method employed in the formation of the grid-shaped rib and therefore the above method and the resist mask are mainly explained below. FIGS. 1A and 1B are partially expanded diagrams showing the resist mask employed in the sandblast method for forming the grid-shaped rib in the manufacturing method of the embodiment. FIG. 1A shows a resist mask 1 corresponding to two or more display cells connected in a horizontal direction and FIG. 1B shows in detail a shape of part of the resist mask shown in FIG. 1A.

The resist mask 1, as shown in FIG. 1A, includes a light-shielding portion 11 corresponding to the grid-shaped rib and an aperture portion 12 corresponding to portions other than the grid-shaped rib. Cuts 13 are formed in portions contacting a rib (partition wall) in a longitudinal direction on both sides in a portion in a horizontal direction intersecting a data electrode in the grid-shaped rib in the light-shielding portion 11. When the grid-shaped rib is formed by the sandblast method using the resist mask 1 shown in FIG. 1, since the cuts 13 are formed in corner portions in the resist mask 1, space is widened, which causes an aperture rate to a cutting agent being jetted. Therefore, lowering in a speed of cutting a grid-shaped rib material using the cutting agent being sprayed can be suppressed.

A unit display cell in a plasma display panel, for example, in the case of one square pixel in a 42-type WVGA (Wide Video Graphic Array) display format, is 1.08 mm in a longitudinal direction and 0.36 mm in a horizontal direction in size and, for example, in the case of one square pixel in a 50-type WXGA (Wide Extended Graphic Array) display format, is 0.81 mm in a longitudinal direction and 0.27 mm in a horizontal direction in size.

In the case of the grid-shaped rib, though a width of one rib in a direction (hereinafter referred to as a column direction) parallel to the data electrode is set to be 50 μm to 80 μm to obtain a sufficient luminance, a width of one rib in a direction (hereinafter referred to as a row direction) intersecting the data electrode, which has not so much influence on luminance, can be set to be as a little large as 50 μm to 200 μm to suppress interference with a neighboring cell in a column direction.

Moreover, in an ordinary case, while the sandblast process is performed, a nozzle to jet a cutting agent is made to move in a reciprocal manner in a column direction parallel to the data electrode direction with considerations being given to a shape of a resist pattern serving as a mask. Therefore, in order to prevent missing of the rib caused by peeling of the resist mask that may occur while the sandblast process is performed and to form corner portions of the grid-shaped rib to be square-shaped being free from torsion, it is necessary that the cuts 13 are formed only in a pattern in a row direction intersecting the data electrode. Moreover, as shown in FIG. 1(*b*), a width of each of the cuts 13 represented by an amount of cut "a" and a depth of each of the cuts 13 represented by an amount of cut "b" both are preferably 30 μm to 50 μm depending on a display cell size and with of one rib.

According to processing accuracy that can be provided by the sandblast method, if a width of one rib is 50 μm or more, it is possible to form a grid-shaped rib with an accuracy of 10 μm or less. Therefore, it can be said that the sandblast method is a rib forming method providing controllability of several tenth microns and thus formation of a cut having a size of 30 μm to 50 μm in each of corner portions of the grid-shaped rib is possible. FIG. 2 shows examples of a grid-shaped rib 21 and a phosphor layer 22 fabricated by the method for manufacturing a plasma display panel of the embodiment of the present invention, in which the grid-shaped rib 21 and phosphor layer 22 are formed so as to be correctly square-shaped.

Thus, according to the method for manufacturing a plasma display panel of the embodiment of the present invention, since each of the corner portions can be formed so as to be square-shaped, discharge space can be widened and an area to be coated with a phosphor can be increased, which enables luminance of a plasma display panel to be enhanced. Moreover, most of the conventional manufacturing method can be applied and therefore performance of a plasma display panel can be improved without causing an increase in manufacturing costs.

Moreover, when a grid-shaped rib is formed by the sandblast method using a resist mask, by forming a cut in each of corner portions in an aperture portion of the resist mask, space for processing is widened which enables suppression of lowering of a speed of cutting a rib material that may occur in a location near to the corner portion. Therefore, by adjusting a width or depth of the cut, while a speed of cutting the rib material in each of the corner portions of each of the grid-shaped rib is improved, the grid-shaped rib can be formed so as to be square-shaped being free from torsion.

Second Embodiment

Figure 3:
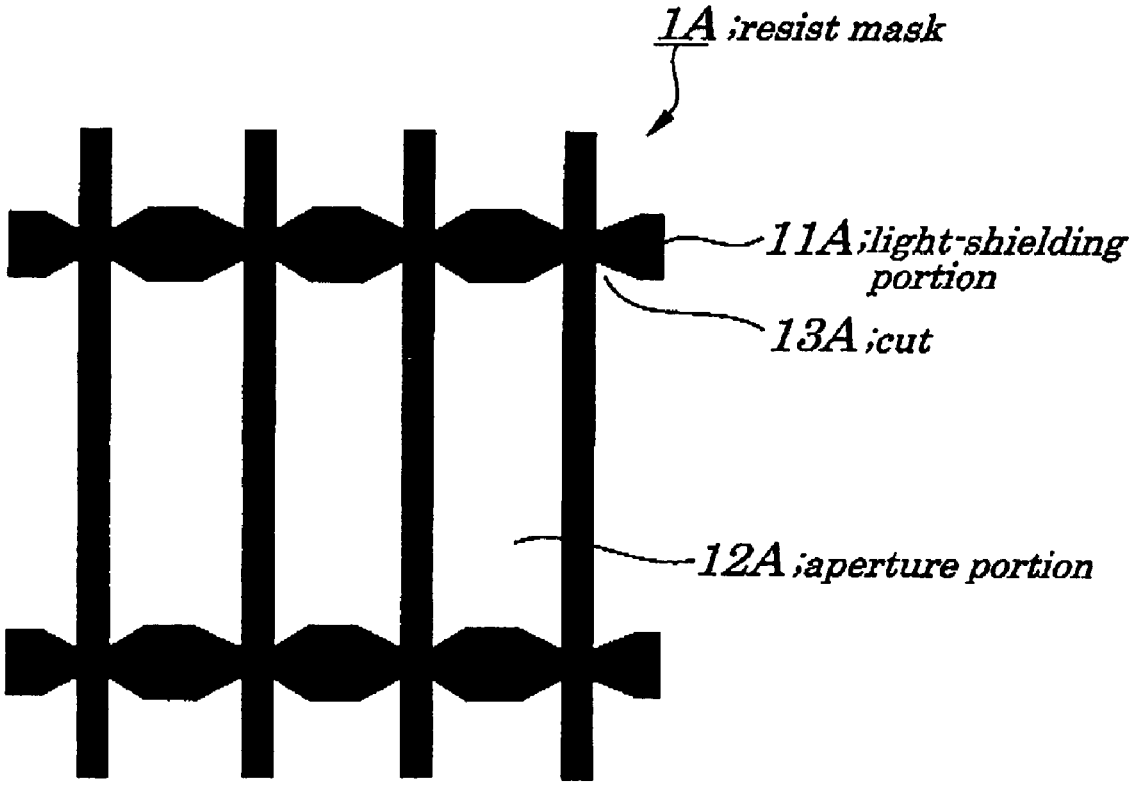
FIG. 3 is a diagram showing a shape of a resist mask employed in a method for manufacturing a plasma display panel according to a second embodiment of the present invention.
Figure 4:
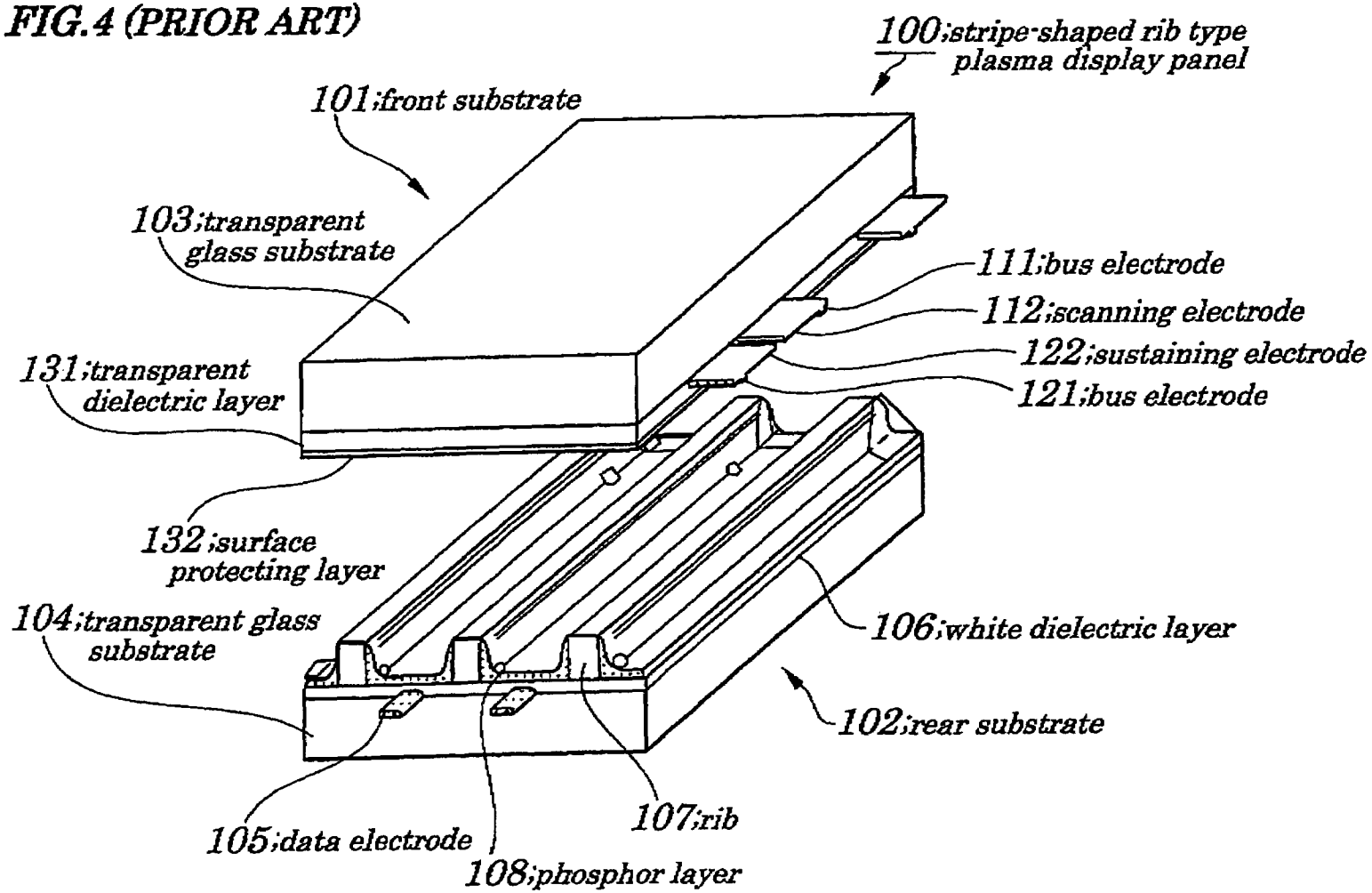
FIG. 4 (PRIOR ART)
FIG. 4 is an exploded perspective view schematically showing a configuration of a conventional stripe-shaped rib type plasma display panel.

FIG. 3 is a diagram showing a shape of a resist mask employed in a method for manufacturing a plasma display panel according to a second embodiment of the present invention. FIG. 3 shows a partially expanded diagram illustrating a resist mask for sandblast processing to be used when a grid-shaped rib is formed by the method for manufacturing a plasma display panel of the second embodiment of the present invention.

A resist mask 1A of the second embodiment, as shown in FIG. 3, includes a light-shielding portion 11A corresponding to the grid-shaped rib and an aperture portion 12A corresponding to portions other than the grid-shaped rib. In a portion where a pattern corresponding to the grid-shaped rib in a direction (row direction) intersecting data electrodes and a pattern corresponding to the grid-shaped rib in a direction (column direction) parallel to the data electrodes on both sides cross one another, triangular cuts 13A in which a width of the pattern in a row direction gradually tapers down toward a pattern in a column direction from a portion nearer to a center are formed on both upper and lower sides on a pattern in a row direction.

When a grid-shaped rib is formed by the sandblast method using the resist mask 1 used in the first embodiment, there are some cases in which, only by adjusting a width "a" or a depth "b" of each of the cuts 13, it is difficult to control the rib corner obtained after being processed so as to have a correct square shape. However, in the resist mask 1A of the second embodiment, since an amount of a cut in each of corner portions becomes larger on a side being nearer to a pattern in a column direction, an amount of cutting at time of sandblast processing becomes larger on a side being nearer to a pattern in a column direction. Therefore, unlike in the case of the first embodiment in which the amount of the cut is the same on the side being nearer to or far from a pattern in a column direction, the corner portions obtained after the sandblast processing can be easily formed so as to be square-shaped being free from torsion.

Also, in the method for manufacturing a plasma display panel of the second embodiment, a width and a depth of each of the cuts 13A is preferably within a range of 30 μm to 50 μm depending on a display cell size and widths of the grid-shaped rib.

Thus, according to the method for manufacturing a plasma display panel of the second embodiment, as in the case of the first embodiment, since each of the corner portions in the grid-shaped rib can be formed so as to be square-shaped, discharge space of a display cell can be widened and an area to be coated with a phosphor can be increased and therefore luminance of a plasma display panel can be enhanced and, since most of the conventional manufacturing method can be employed, performance of a plasma display panel can be improved without causing an increase in manufacturing costs.

Also, when the grid-shaped rib is formed by the sandblast method using the resist mask, by forming a tapered-down cut in each of the corner portions in the aperture portion on the resist mask, space for processing can be widened, which enables suppression of lowering of a speed of cutting a rib material that may occur in a location being near to each of the corner portions. As a result, as in the case of the first embodiment, by adjusting the width and/or depth of the cut, the speed of cutting the rib material in each of the corner portions in the grid-shaped rib is improved and each of the corner portions in the grid-shaped rib can be formed to be square-shaped being free from torsion.

It is apparent that the present invention is not limited to the above embodiments but may be changed and modified without departing from the scope and spirit of the invention. For example, the grid-shaped rib may be formed not only by the sandblast method but also by a printing method in which the grid-shaped rib is formed by printing a paste-like rib material in a multiple manner using a screen format or by an additive method in which the grid-shaped rib is fabricated by forming a pattern on a photosensitive dry film resist and embedding a rib material and then by removing the dry film resist. It is needless to say that a mask pattern to be used in the printing method or the additive method has to be a reversed pattern of the resist mask used in the sandblast. Moreover, in the case of the second embodiment, by forming a cut having a shape whose amount of cutting changes in a curve as the cut comes near to the pattern in a column direction instead of the triangular cut which becomes large linearly in a taper-like form from a side being far from the pattern in a column direction toward a side being near to a pattern in the column direction, each of the corner portions in the grid-shaped rib can be formed so as to be square-shaped being more free from torsion.

What is claimed is:

1. A method for manufacturing a plasma display panel in which a front substrate having row electrodes and a rear substrate having column electrodes extending in a direction intersecting said row electrodes are arranged with a grid-shaped ribs being interposed between said front substrate and said rear substrate in a manner in which said front substrate and said rear substrate face each other, said method comprising:

a step of forming said grid-shaped ribs using a mask having a pattern corresponding to a shape of said grid-shaped ribs, said pattern having a plurality of first stripes extending in a row direction and a plurality of second stripes extending in a column direction so as to cross each other at intersections, wherein each of said first stripes is reduced in width around said intersections while said second stripes all have the same width along their lengths so that four cuts are formed around each of said intersections and each of said cuts is defined by the width-reduced part of each of said first stripes and each of said second stripes.

2. The method for manufacturing a plasma display panel according to claim 1, wherein said mask is a resist mask to be used in a sandblast method and said grid-shaped ribs are formed by said sandblast method.

3. A method for manufacturing a plasma display panel in which a front substrate having row electrodes and a rear substrate having column electrodes extending in a direction intersecting said row electrodes are arranged with grid-shaped ribs being interposed between said front substrates and said rear substrate in a manner in which said front substrate and said rear substrate face each other, wherein a width of said grid-shaped ribs in a row direction is made larger than that in a column direction, said method comprising:

a step of forming said grid-shaped ribs using a mask having a pattern corresponding to said grid-shaped ribs, said pattern having a plurality of first stripes extending in a row direction and a plurality of second stripes extending in a column direction so as to cross each other at intersections, wherein each of said first stripes is reduced in width around said intersections while said second stripes all have the same width along their lengths so that four cuts are formed around each of said intersections and each of said cuts is defined by the width-reduced part of each of said first stripes and each of said second stripes.

4. The method for manufacturing a plasma display panel according to claim 3, wherein said mask is a resist mask to be used in a sandblast method and said grid-shaped ribs are formed by said sandblast method.

5. A method for manufacturing a plasma display panel comprising:

a step of forming a rib substrate so as to have a specified thickness;

a step of forming a mask on said rib substrate, said mask having a grid-shaped pattern with a plurality of first stripes extending in a first direction and a plurality of second stripes extending in a second direction so as to cross each other at intersections, wherein each of said first stripes is reduced in width around said intersections while said second stripes all have the same width along their lengths; and a step of spraying a cutting agent on said rib substrate via said mask from a nozzle moving along said second direction, hereby forming grid-shaped ribs.

6. A method for manufacturing a plasma display panel in which a discharge space is partitioned by a plurality of horizontal ribs and a plurality of vertical ribs, said horizontal ribs and said vertical ribs having different widths to each other and crossing each other at intersections, said method comprising:

a step of forming said horizontal ribs and vertical ribs by using a mask having a pattern corresponding to said horizontal and vertical ribs, said pattern having a plurality of first stripes extending in a horizontal direction and a plurality of second stripes extending in a vertical direction so as to cross each other at intersections, wherein stripes selected from either said first stripes or said second stripes whichever widths thereof at centers between adjacent intersections are larger are reduced in width around said intersections while the other stripes all have the same width along their lengths.

7. A method for manufacturing a plasma display device comprising:

a first step of manufacturing a plasma display panel;

a second step of manufacturing said plasma display panel and a circuit to drive said plasma display panel as one module;

a third step of electrically connecting an interface to said module, said interface which converts a format of an image signal and transmits the converted image signal to said module;

wherein, in said first step, grid-shaped ribs are formed using a mask having a pattern, said pattern having a plurality of first stripes extending in a row direction and a plurality of second stripes extending in a column direction which are crossed each other at intersections, wherein each of said first stripes is reduced in width around said intersections while said second stripes all have the same width along their lengths.

8. The method for manufacturing a plasma display panel according to claim 1, wherein widths of said first stripes at centers between adjacent intersections are wider than those of said second stripes.

9. The method for manufacturing a plasma display panel according to claim 1, wherein each of said first stripes is steeply reduced in width such that said cuts have right-angled shapes.

10. The method for manufacturing a plasma display panel according to claim 1, wherein each of said first stripes is gradually reduced in width such that each of the width-reduced parts of said first stripes has a wedge shape.

11. The method for manufacturing a plasma display panel according to claim 9, wherein each of said cuts has a dimension ranging from 30 μm×30 μm to 50 μm×50 μm.

12. The method for manufacturing a plasma display panel according to claim 3, wherein each of said first stripes is steeply reduced in width such that said cuts have right-angled shapes and each of said cuts has a dimension ranging from 30 μm×30 μm to 50 μm×50 μm.

* * * * *